US007817812B2

(12) United States Patent
Polk, Jr. et al.

(10) Patent No.: US 7,817,812 B2
(45) Date of Patent: Oct. 19, 2010

(54) COMPACT AUDIO REPRODUCTION SYSTEM WITH LARGE PERCEIVED ACOUSTIC SIZE AND IMAGE

(75) Inventors: Matthew S. Polk, Jr., Gibson Island, MD (US); Bradley M. Starobin, Baltimore, MD (US)

(73) Assignee: Polk Audio, Inc., Baltimore, MD (US)

( * ) Notice: Subject to any disclaimer, the term of this patent is extended or adjusted under 35 U.S.C. 154(b) by 1541 days.

(21) Appl. No.: 11/139,611

(22) Filed: May 31, 2005

(65) Prior Publication Data

US 2006/0269069 A1 Nov. 30, 2006

(51) Int. Cl.
*H04R 5/02* (2006.01)
*H04R 5/00* (2006.01)

(52) U.S. Cl. ..... 381/300; 381/1; 381/17; 381/18; 381/19; 381/310; 381/304

(58) Field of Classification Search ..... 381/1, 381/17–19, 300–310, 21
See application file for complete search history.

(56) References Cited

U.S. PATENT DOCUMENTS

| | | | | |
|---|---|---|---|---|
| 2,710,662 | A | 6/1955 | Camras | |
| 3,104,729 | A | 9/1963 | Olson | |
| 3,153,120 | A | 10/1964 | Brown | |
| 3,582,553 | A | 6/1971 | Bose | |
| 3,627,948 | A | 12/1971 | Nichols | |
| 3,727,004 | A | 4/1973 | Bose | |
| 3,892,624 | A | 7/1975 | Shimada | |
| 4,053,711 | A * | 10/1977 | DeFreitas et al. | 381/18 |
| 4,151,369 | A * | 4/1979 | Gerzon | 381/21 |
| 4,308,423 | A | 12/1981 | Cohen | |
| 4,489,432 | A | 12/1984 | Polk | |
| 4,748,669 | A | 5/1988 | Klayman | |
| 5,757,927 | A * | 5/1998 | Gerzon et al. | 381/20 |
| 5,799,094 | A | 8/1998 | Mouri | |
| 5,912,976 | A | 6/1999 | Klayman et al. | |
| 6,173,061 | B1 | 1/2001 | Norris et al. | |
| 2002/0154783 | A1 | 10/2002 | Kraemer | |
| 2004/0005066 | A1 * | 1/2004 | Kraemer | 381/17 |
| 2005/0089181 | A1 | 4/2005 | Polk, Jr. | |

* cited by examiner

OTHER PUBLICATIONS

Search Report, dated Feb. 16, 2007, for International Application No. PCT/US06/21025, 9 pgs.

*Primary Examiner*—Devona E Faulk
(74) *Attorney, Agent, or Firm*—J. A. McKinney, Jr.

(57) ABSTRACT

A compact audio reproduction system for two input signals includes at least four loudspeakers disposed at the vertices of a quadrilateral not more than two feet on any side and such that no two loudspeakers are located at a distance from one another which is less than one-fourth the greatest distance between any two loudspeakers. The two input signals are connected to alternate speakers such that no two loudspeakers at adjacent vertices of the quadrilateral produce the same signal such that a listener at an arbitrary location perceives a sound source larger than the quadrilateral and significant stereo image. The signals received by two loudspeakers located at adjacent vertices may receive signals which are equalized separately from the signals received by the other loudspeakers for the purpose of reducing comb filtering and improving the tolerance of the device to placement near walls and other obstructions. Two loudspeakers may be delayed by a time corresponding to a sound distance at least equal to the shortest distance between two loudspeakers and not greater than the longest distance between two loudspeakers, for the purpose of reducing comb filtering and improving the perception of large sound source size and stereo imaging for listeners at arbitrary locations.

20 Claims, 5 Drawing Sheets

COMPACT AUDIO REPRODUCTION SYSTEM WITH LARGE PERCEIVED ACOUSTIC SIZE AND IMAGE

BACKGROUND OF THE INVENTION

1. Field of the Invention

The present invention relates generally to compact audio reproduction systems, and in particular to improving the perceived size of the sound source in compact audio reproduction systems.

2. Background Art

Conventional compact audio reproduction systems, such as televisions, shelf systems, computers, portable entertainment centers ("boom boxes"), and table radios, for example, have the general problem that they are perceived to sound "small" and at least partly as a result, such systems fail to provide a satisfying auditory experience. The perceived size of a sound source is, of course, related to the physical extent of the sound source. In addition the perceived size of a sound source depends on a number of psychoacoustic factors, many of which are poorly understood. Apparent source size has also been shown to be related to "spaciousness" or the sensation of acoustic envelopment, such as when radiating sound sources perceived to be large envelop listeners in a diffuse sound field. For example, a number of physically small sound sources widely distributed around a room may produce the impression of a large sound source by combining sound from many directions or they may create the impression of a large sound stage by creating multiple sound images around the room and a more diffuse sound field within the room. Of course, this particular manner of enveloping listeners within a diffuse sound field, giving rise to an impression of a large sound source, is not possible in a compact audio reproduction system where all of the sound sources are located in close proximity to each other. An additional dimension to the problem is that compact audio reproduction systems may be used in almost any conceivable orientation and that listeners may be almost anywhere relative to the position of the system and, further, may move about while listening.

Many different techniques have been applied to increasing the perceived size of a sound source, with varying degrees of success. One common technique has been to use two loudspeakers with a portion of the frequency range fed to one of the speakers intentionally out of phase. As is well known, out-of-phase signal components are poorly localized and tend to create the impression of a larger sound source by delocalizing the direct sound from the source. However, this technique often results in significant acoustic magnitude (frequency response) aberrations. Many listeners also perceive the "everywhere but nowhere" character of the out-of-phase signals as unpleasant.

A variation of the out-of-phase technique is the use of various combinations of so-called difference signals created by subtracting the left channel from the right channel, L-R, or vice-versa to create R-L. Difference signals generally are considered to contain proportionally greater amounts of uncorrelated ambience information. Use of difference signals to create a greater sense of ambience can be successful in creating a perception of a larger, more room filling sound but frequently at the cost of reduced intelligibility and the general perception that the sound is "less solid". Several variations of the difference signal technique have been used and perform well in situations where the location of the listener relative to the sound sources is known. Such systems are disclosed, for example, in U.S. Pat. No. 4,748,669 to Klayman, U.S. Pat. No. 4,489,432 to Polk, and U.S. Pat. No. 4,308,423 to Cohen.

However, these techniques are generally not successful for applications where the system's sound radiating elements (sound sources) are very close together and in situations where the acoustic environment of the system and location of the listeners is arbitrary.

Various other techniques have been used including multidirectional sound sources which seek to increase perceived sound source size by radiating sound in many directions. Examples of these include U.S. Pat. No. 3,104,729 to Olson and U.S. Pat. No. 3,627,948 to Nichols. Other techniques utilize a combination of reflected and direct sound such as U.S. Pat. No. 3,727,004 to Bose and early attempts to expand the perceived image of monaural systems, such as U.S. Pat. No. 2,710,662 to Camras, filed in 1946. Such techniques generally have been applied to the design of individual loudspeakers reproducing a single audio signal (channel) and intended for use in multiples, one for each signal channel, spaced widely apart, as in a stereo reproduction system or surround sound system. However, in a compact audio reproduction system the individual speakers reproducing each signal channel are typically very close to each other, often less than one foot apart. In this case, conventional multidirectional sound techniques may contribute to the impression of a larger sound source by creating a more diffuse sound field but, due to the close proximity of the sound sources to each other, they fail to preserve any sense of stereo imaging. In addition, when implemented at such a small scale, the resulting comb filtering inherent in many of these designs may lead to subjectively unacceptable levels of sound coloration. U.S. Pat. No. 3,582,553 to Bose discloses a single speaker stereo arrangement, see FIG. 7 and FIG. 9, employing multi-directional sound where most of the sound is radiated by left and right rear speakers which receive modified left and right signals, respectively. A lesser quantity of sound is radiated by front speakers which receive either a center channel signal or modified sum signal. This system avoids the problems associated with difference signals, out of phase signals and, to some extent, reduces comb filtering by maintaining a high ratio of indirect sound to direct sound. It relies on a complex pattern of reflected sounds to increase the perceived sound source size and maintain an impression of stereo imaging. Such a system may work well in certain situations which permit the system to be correctly positioned to deliver the required reflected sounds to a predetermined listening area.

A combination of the difference signal and reflected sound approach is shown in U.S. Pat. No. 3,892,624 to Shimada, where modified difference signals in opposite phase are applied to a pair of closely spaced drive units. In another embodiment, see FIG. 17 and FIG. 18, a second set of closely spaced auxiliary rear drive units receiving the same modified difference signals as their corresponding front drive units are used to generate reflected sounds for the purpose of enhancing the stereophonic effect. In a further embodiment a delay is applied to the signals reproduced by the auxiliary rear speakers for the purpose of creating an echo effect. However, as may be readily appreciated, the use of out of phase difference signals contributes to a perception that the sound is "less solid" and the use of uncompensated auxiliary rear drive units producing the same signals leads to comb filtering in addition to a perception of acoustic coloration in the reproduced sound. Introduction of a delay to these rear signals simply shifts the acoustic anomalies to lower frequencies.

U.S. Pat. No. 3,153,120 to Brown also shows the use of modified difference signals to provide stereo reproduction from a single cabinet. In one embodiment the difference signals are applied in opposite phase to a pair of closely spaced drive units facing in opposite directions which are supplemented by forward facing drive units receiving a modified sum of the two input signals. This approach suffers from the previously discussed shortcomings of both the use of difference signals and out-of-phase techniques.

So-called "virtual surround" techniques have also been used to enlarge the apparent sound source size. These techniques which utilize complex audio signal processing, attempt to create a surround sound like experience from a single pair of loudspeakers. Examples of such systems are disclosed, for example, in U.S. Pat. No. 5,799,094 to Mouri, U.S. Pat. No. 6,173,061 to Norris, and U.S. Pat. No. 5,912,976 to Klaymen. Such schemes rely on a specific relationship between the locations of the speakers and the listener, require the listener to remain in a certain location and typically require a distance between the individual speakers greater than would be practical for a compact system such as, for example, a table radio.

BRIEF SUMMARY OF THE INVENTION

Accordingly, it is an object of the present invention to provide a compact audio reproduction system for at least two input signals which is perceived as a sound source much larger than its actual physical size.

It is a further object of the present invention to provide a compact audio reproduction system for at least two input signals which preserves significant stereo or multi-channel imaging.

It is yet another object of the present invention to provide a compact audio reproduction system for at least two input signals whose performance in achieving the above objectives is tolerant of placement in a variety of acoustic environments.

It is an additional object of the present invention to provide a compact audio reproduction system for at least two input signals which is perceived by listeners in arbitrary locations relative to the system as a sound source much larger than its actual physical size and which preserves significant stereo or multi-channel imaging.

In accordance with an embodiment of the invention, in a compact audio reproduction system for two input signals, at least four loudspeakers are disposed at the vertices of a rectangle not more than two feet on any side with an aspect ratio of not more than 4:1. The two input signals are connected to alternate loudspeakers such that no two loudspeakers at adjacent vertices of the rectangle produce the same signal such that a listener at an arbitrary location perceives a sound source larger than the rectangle and significant stereo image.

In accordance with another embodiment of the invention, in a compact audio reproduction system for two input signals, at least four loudspeakers are disposed at the vertices of a quadrilateral of arbitrary shape not more than two feet on any side and such that no two loudspeakers are located at a distance from one another which is less than one-fourth the greatest distance between any two loudspeakers. The two input signals are connected to alternate loudspeakers such that no two loudspeakers at adjacent vertices of the quadrilateral produce the same signal such that a listener at an arbitrary location perceives a sound source larger than the quadrilateral and significant stereo image.

In accordance with another embodiment of the invention, in a compact audio reproduction system for two input signals, two loudspeakers of the first or second embodiments located at adjacent vertices receive signals which are equalized separately from the signals received by the other loudspeakers for the purpose of reducing comb filtering and improving the tolerance of the device to placement near walls and other obstructions.

In accordance with another embodiment of the invention, in a compact audio reproduction system for two input signals, two loudspeakers of the first or second embodiments are delayed by a time corresponding to a sound distance at least equal to the shortest distance between two loudspeakers and not greater than the longest distance between two loudspeakers, for the purpose of reducing comb filtering and improving the perception of large sound source size and stereo imaging for listeners at arbitrary locations.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
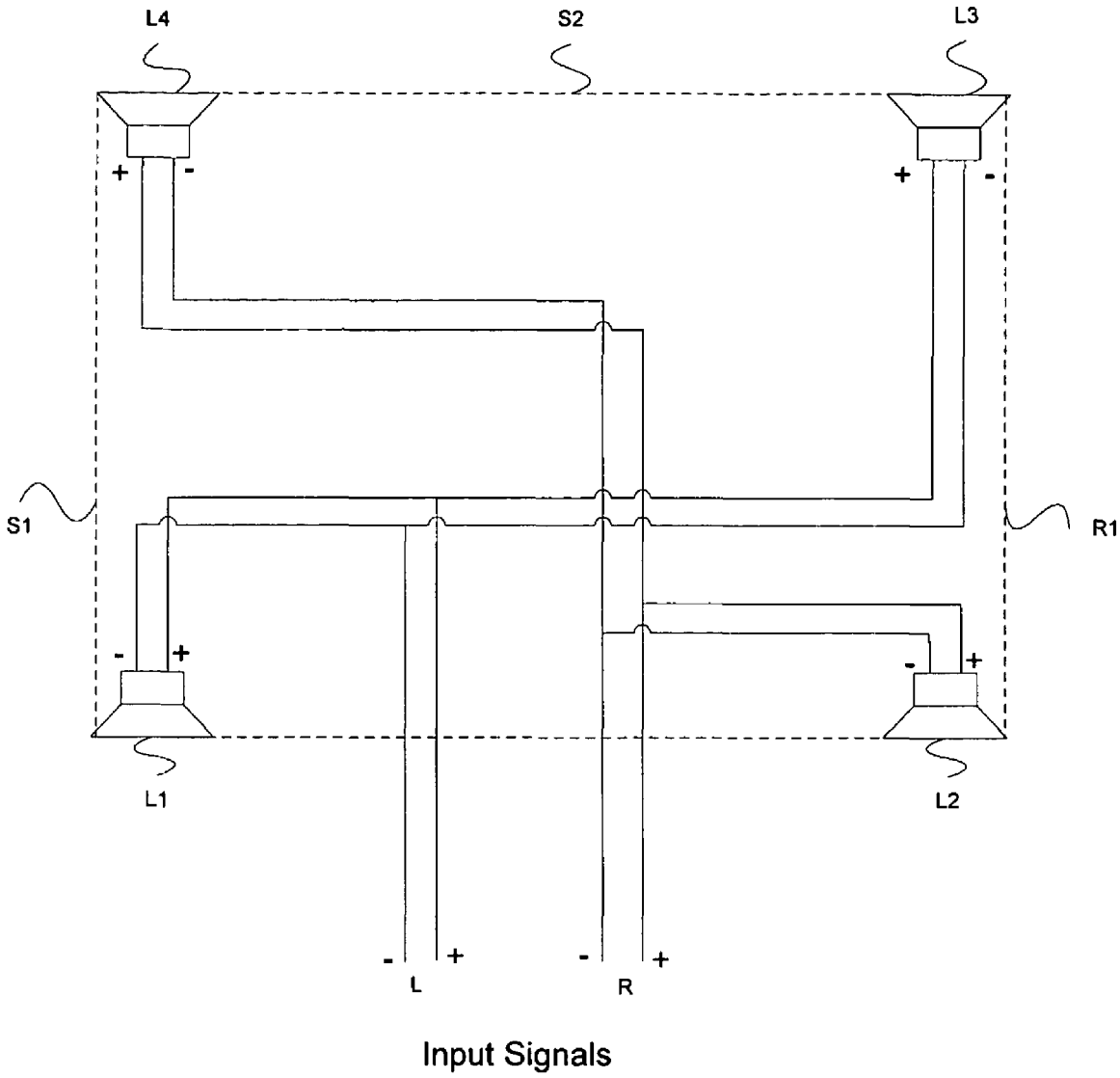
FIG. 1 shows a plan view of an embodiment of the present invention with four loudspeakers in a rectangular arrangement.

Embodiments of the present invention are now described with reference to the figures where like reference characters/numbers indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention.

FIG. 1 shows a first embodiment of the present invention. Loudspeakers L1, L2, L3, and L4 are located approximately at the vertices of a rectangle R1, and are generally oriented to radiate sound away from the center of the rectangle. A first input signal L is connected to loudspeakers L1 and L3 disposed diagonally to each other. A second input signal R is connected to loudspeakers L2 and L4 disposed diagonally to each other. The length of the side S1 between loudspeakers L1 and L4 is approximately equal to the length of the side between loudspeakers L2 and L3. Similarly, the length of the side S2 between loudspeakers L3 and L4 is approximately equal to the length of the side between loudspeakers L1 and L2. As is well known to those skilled in the art, correlated interaural differences at the two ears of a listener are responsible for sound image localization while uncorrelated interaural differences are believed to be responsible for the perception of sound source size. It has been found experimentally that for a listener located at an arbitrary position around the system of FIG. 1, this arrangement provides sufficient interaural differences both correlated and uncorrelated at the two ears of the listener to provide a perception that the sound source is larger than the physical extent of the system and to provide a significant perception of stereo separation and imaging.

Referring again to FIG. 1, it has also been determined experimentally that the largest dimension S2 of the rectangle R1, which determines the locations of loudspeakers L1, L2, L3 and L4, should not be greater than approximately 2 feet or less than approximately 4 inches and that the aspect ratio of the rectangle R1, calculated by taking the ratio of the length of the longest side to the length of the shortest side should not be greater than 4 to 1. Experiments have shown that this range of dimensions reduces comb filtering in frequency ranges likely to be perceived as deleterious to the acoustic performance of the system. Experiments have also shown that that this range of dimensions contributes to the perception of a larger image size and preservation of some stereo image. It is believed that this is a result of the relationship of these dimensions to the interaural distance of approximately 6.75 inches. In a specific embodiment of the present invention the dimensions of the longest and shortest sides of rectangle R1 are 9 inches and 6 inches respectively.

Figure 2:
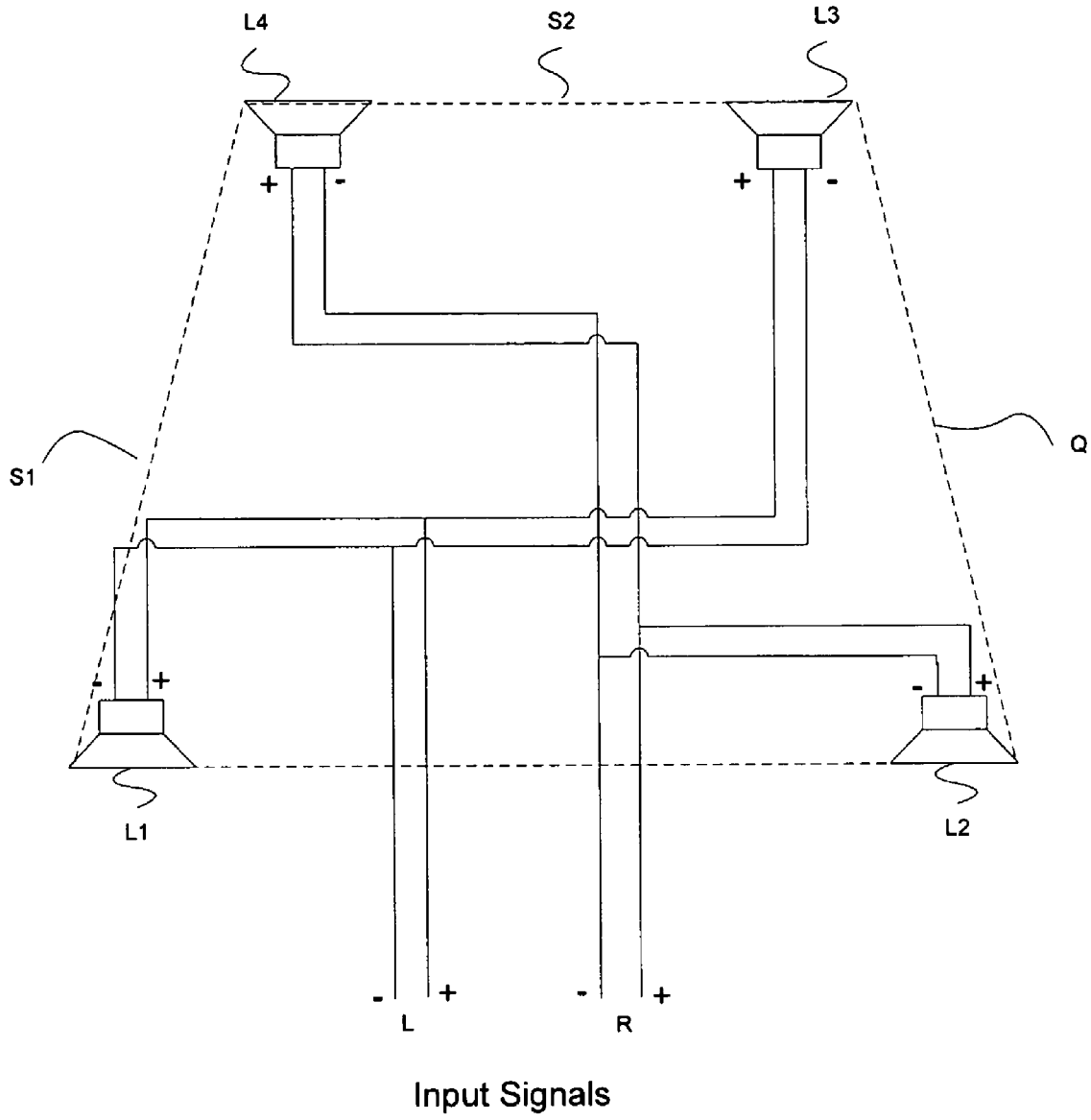
FIG. 2 shows a plan view of an embodiment of the present invention with four loudspeakers located at vertices of an arbitrary quadrilateral.

FIG. 2 shows a second embodiment of the present invention. This embodiment operates identically to the first embodiment except that the loudspeakers are located at the vertices of a quadrilateral Q of arbitrary shape.

In this particular embodiment, a trapezoid is illustrated, however, it should be understood that many different shapes of quadrilaterals can be used to provide acceptable locations for loudspeakers L1, L2, L3 and L4 so long as the greatest distance between any two loudspeakers is not more than four times the shortest distance between any two loudspeakers.

Figure 3:
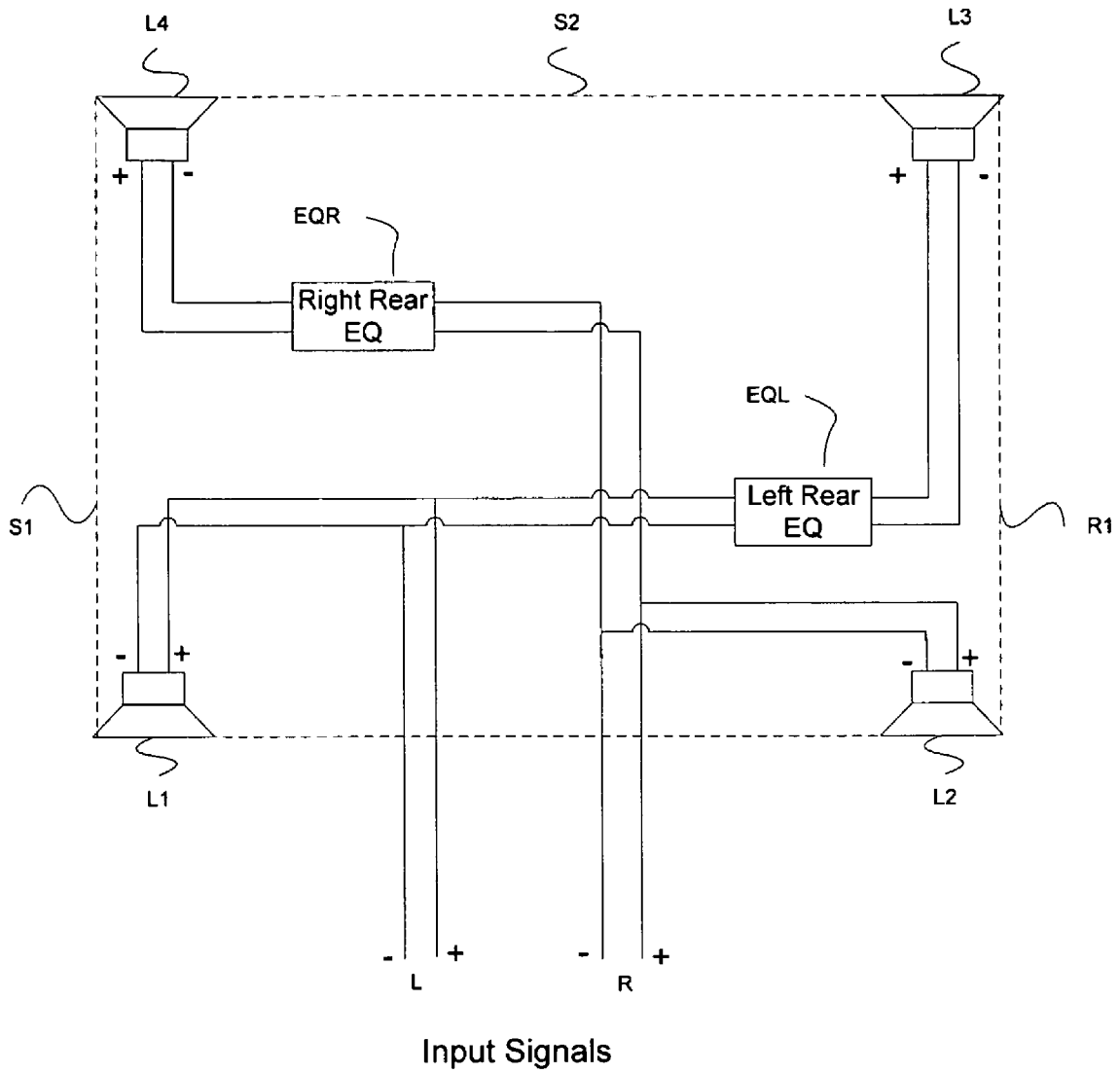
FIG. 3 shows a plan view of an embodiment of the present invention with separate equalization of the rear loudspeakers.

FIG. 3 shows a third embodiment of the present invention. This embodiment functions similarly to the first and second embodiments. In this third embodiment, loudspeakers L1 and L2 are designated as front loudspeakers and loudspeakers L3 and L4 are designated rear loudspeakers.

Rear loudspeakers L3 and L4 receive a separately modified version of the first and second input signals L and R. The modification means EQL and EQR may include, by way of example and not of limitation, equalization of the frequency response of the input signals so as to reduce comb filtering and to improve the perceived audio performance when the device is located near an obstruction such as a wall. The loudspeakers L3 and L4 receiving the modified input signals L and R would typically face more or less towards the obstruction while loudspeakers L1 and L2 would typically face more or less away from the obstruction.

In one implementation of this third embodiment the modification means EQL and EQR includes a band reject filter. In a particular implementation, such a band reject filter is centered approximately between 400 Hz and 2,000 Hz with approximate bandwidth of between 1 and 3 octaves and gain approximately between minus 4 db and minus 10 db. In another implementation of this third embodiment the signal modification means EQL and EQR includes a high frequency roll-off. In a particular implementation, the high frequency roll-off provides gain of approximately minus 6 db at a frequency approximately between 2 kHz and 10 kHz. Other examples of modification means EQL and EQR may include combinations of high-pass and low bass filer, band emphasis or reject filters, and high or low shelving filters implemented in either analog or digital circuitry.

Figure 4:
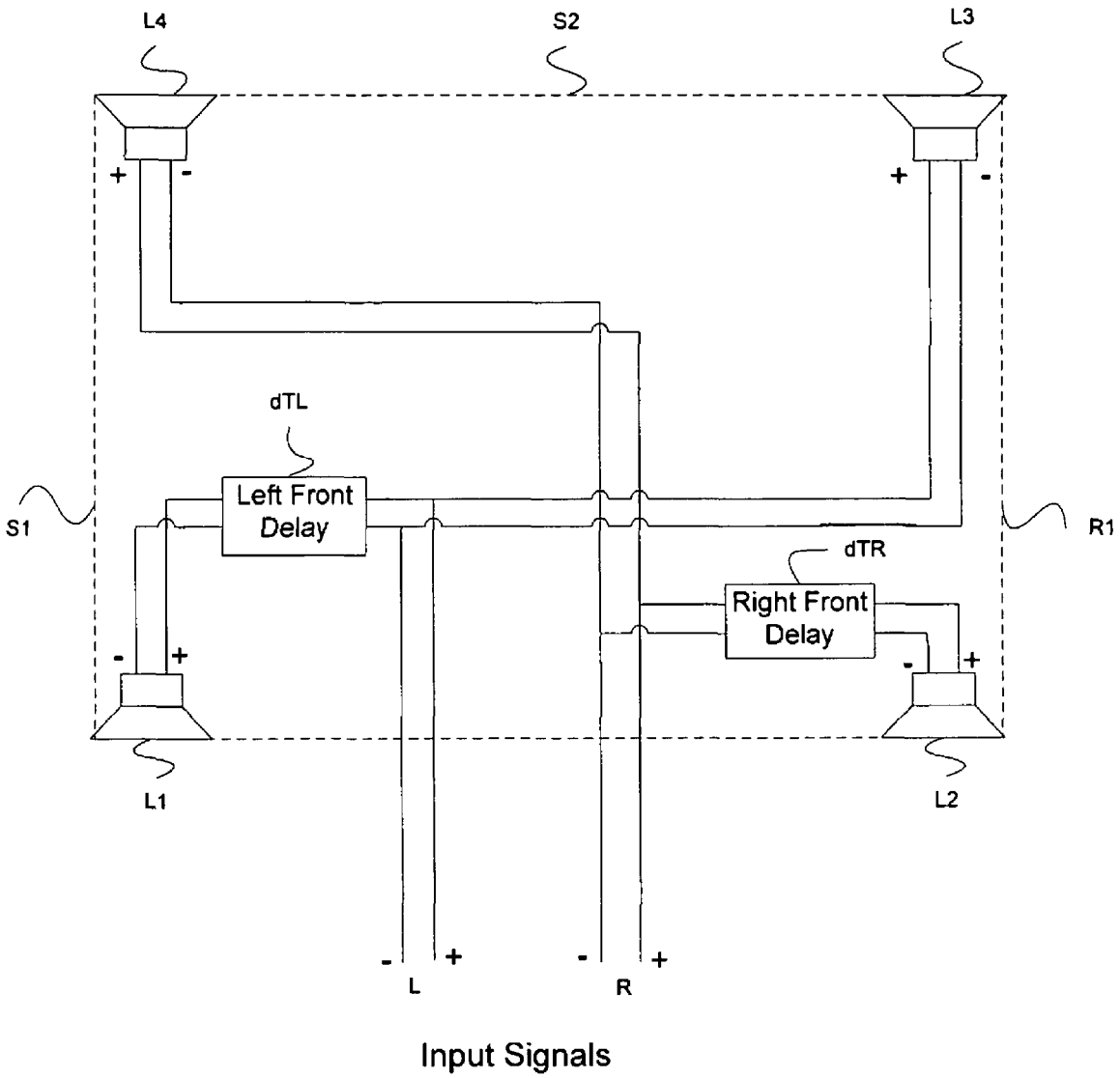
FIG. 4 shows a plan view of an embodiment of the present invention with the separately delayed signals for the front loudspeakers.

FIG. 4 shows a fourth embodiment of the present invention. This embodiment functions similarly to the first and second embodiments and, as in the third embodiment, loudspeakers L1 and L2 are designated as front loudspeakers and loudspeakers L3 and L4 are designated rear loudspeakers. In this fourth embodiment, front loudspeakers L1 and L2 receive separately modified versions of the first and second input signals L and R, wherein the modification means dTL and dTR include a delay. While it is possible to implement short time delays using analog circuitry, this is cumbersome. Delays are typically implemented in various forms of digital signal processing and may also be combined with various forms of frequency response modification. Typically loudspeakers L1 and L2 receiving the delayed input signals face more or less away from any obstruction and toward the most likely listening areas. It has been determined experimentally that a delay corresponding approximately to a sound distance greater than the shortest distance between a front loudspeaker and a rear loudspeaker and less than the largest distance between a front loudspeaker and a rear loudspeaker serves to reduce comb filtering as perceived by listeners in arbitrary locations around the device and also to enhance the perception of stereo separation and imaging.

In one implementation of this fourth embodiment, the left and right front delays dTL and dTR are approximately equal to the sound distance S1 between front loudspeaker L1 and the nearest rear loudspeaker L4. In a specific implementation of this fourth embodiment, the sound distance S1 between front loudspeakers L1 and L2 and rear loudspeakers L4 and L3, respectively, is approximately 6 inches and the left and right front delay dTL and dTR are approximately equal to 0.75 milliseconds.

Figure 5:
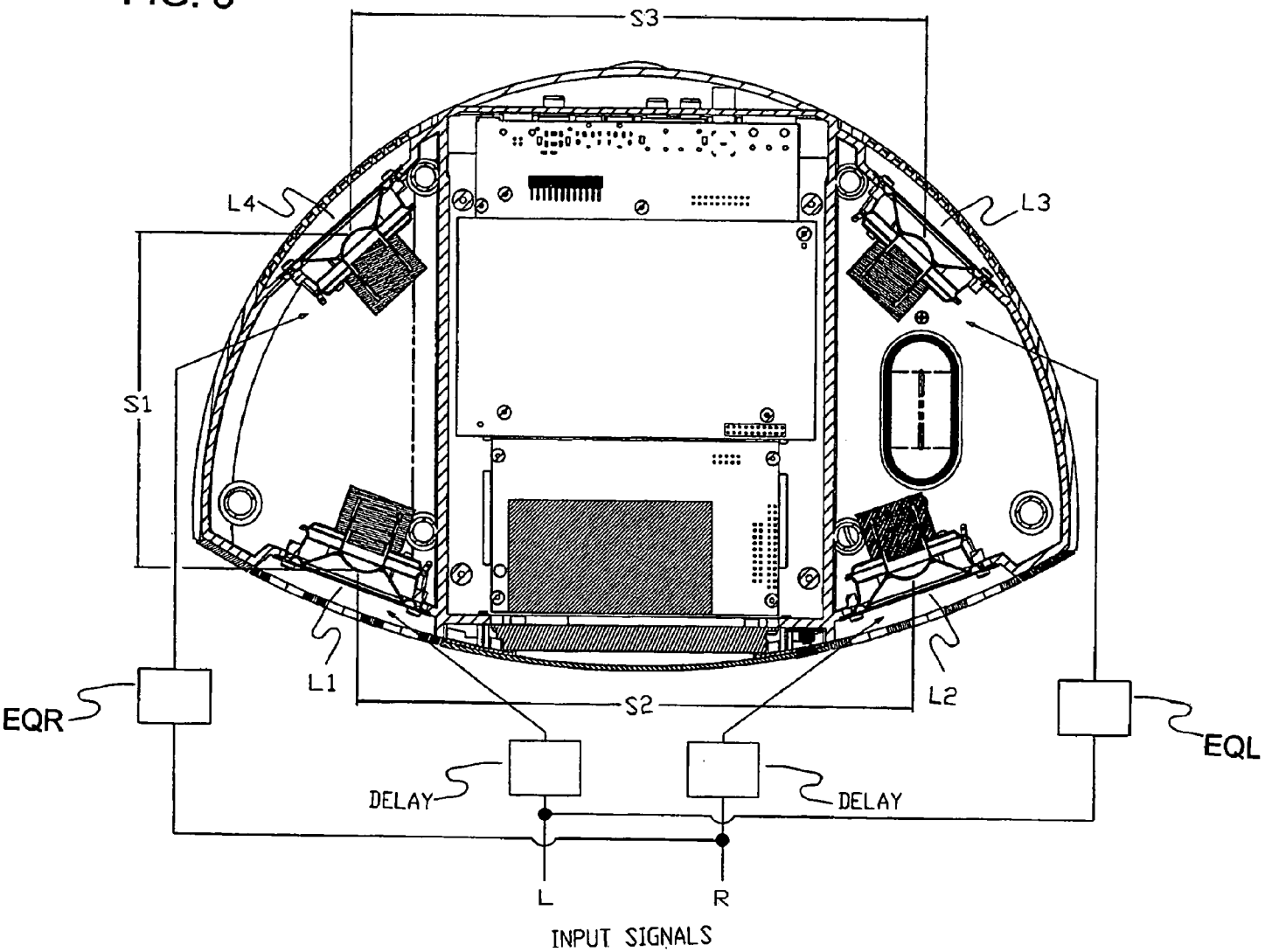
FIG. 5 shows a drawing of a specific example of the present invention.

FIG. 5 shows a fifth embodiment of the present invention. Left and right front loudspeakers L1 and L2 are located at a first distance S1 from the left and right rear loudspeakers L4 and L3, respectively. Left and right front loudspeakers L1 and L2 are located a second distance S2 from each other. Left and right rear loudspeakers L4 and L3 are located at a third distance S3 from each other. As shown in FIG. 5, all four loudspeakers are mounted in the same unitary physical structure. Left and right input signals L and R are connected to left and right front loudspeakers L1 and L2, respectively for the purpose of being reproduced by the right and left front loudspeakers. Left and right input signals L and R are also connected to the right and left rear loudspeakers L3 and L4, respectively, for the purpose of being reproduced by the right and left rear loudspeakers. In a specific implementation of this fifth embodiment, the first, second and third distances S1, S2, and S3 have approximately the following values:

S1—6 inches

S2—8.5 inches

S3—9.5 inches

In a further implementation of this fifth embodiment, signal modification means EQR and EQL are included for separately equalizing the signals connected to the left and right rear loudspeakers L4 and L3 for the purpose of being reproduced by the left and right rear loudspeakers.

In yet another implementation of this fifth embodiment, means are included for delaying the signals connected to the left and right front loudspeakers for the purpose of being reproduced by the left and right front loudspeakers L1 and L2. In a specific implementation of this aspect of this fifth embodiment the delay is approximately equal to 0.75 millisecond.

Further applications of the methods herein disclosed will be apparent to those skilled in the art. By way of example and not of limitation, various combinations of the rear loudspeaker equalization and front loudspeaker delay described above in the third and fourth embodiments may be used with any of the geometric arrangements for the front and rear loudspeakers described in the other embodiments. These implementations are also considered to be within the scope of the present invention. Additional embodiments are contained within the claims.

What is claimed is:

1. An audio reproduction system comprising:

a first audio input signal and a second audio input signal;

a first, a second, a third and a fourth loudspeaker wherein said first, second, third and fourth loudspeakers are located at the first, second, third and fourth vertices, respectively, of a quadrilateral, and are oriented to radiate sound away from the quadrilateral;

wherein the maximum distance between any two of said first, second, third and fourth loudspeakers is not more than four times the minimum distance between any two of said first, second, third and fourth loudspeakers;

means for transmitting said first input signal to said first and said third loudspeakers, wherein said first and third loudspeakers reproduce sound associated with signals received by said first and third loudspeakers; and means for transmitting said second input signal to said second and fourth loudspeakers, wherein said second and fourth loudspeakers reproduce sound associated with signals received by said second and fourth loudspeakers, wherein no two adjacent loudspeakers reproduce the same input signal; and wherein the sound reproduced by said first, second, third and fourth loudspeakers is perceived by a listener to be a sound source larger than the physical size of the quadrilateral.

2. The system of claim 1 wherein the quadrilateral is a rectangle with no side longer than 2 feet.

3. The system of claim 2 wherein the rectangle is approximately 9 inches wide and 6 inches deep.

4. The system of claim 1 wherein the quadrilateral is a trapezoid with no side longer than 2 feet.

5. The system of claim 1, further comprising: signal modification means for modifying said first and second input signals; and means for transmitting said modified first and second input signals to said third and fourth loudspeakers.

6. The system of claim 5, wherein the signal modification means includes frequency response equalization including a band reject filter centered between 400 Hz and 2,000 Hz with bandwidth of greater than 1 octave and attenuation greater than minus 4 db.

7. The system of claim 1, further comprising: signal means for delaying said first and second input signals by a time corresponding to a sound distance; and means for transmitting said delayed first and second input signals to said first and second loudspeakers, wherein the first and second loudspeakers are generally closer to a preferred listening area than the third and fourth loudspeakers.

8. The system of claim 7, wherein said sound distance is greater than or equal to the shortest distance between any two of said first, second, third and fourth loudspeakers and less than or equal to the largest distance between any two of said first, second, third and fourth loudspeakers.

9. The system of claim 8 wherein the sound distance is approximately equal to six inches.

10. The system of claim 8 wherein the sound reproduced by said first, second, third and fourth loudspeakers in said preferred listening area has reduced comb filtering.

11. The system of claim 8 wherein the sound reproduced by said first, second, third and fourth loudspeakers in said preferred listening area has improved stereo imaging.

12. A compact audio reproduction system, comprising:

a unitary physical structure encloses a volume and has sidewalls defining a housing having first, second, third and fourth vertices;

signal processing circuitry supported within said unitary physical structure is configured to provide first and second input signals;

a first, a second, a third and a fourth loudspeaker wherein said first, second, third and fourth loudspeakers are within said unitary physical structure and located at the first, second, third and fourth vertices, respectively, of the housing, and are oriented to radiate sound away from the quadrilateral; wherein the maximum distance between any two of said first, second, third and fourth loudspeakers is not more than four times the minimum distance between any two of said first, second, third and fourth loudspeakers;

wherein said signal processing circuitry is configured to transmit said first input signal to said first and said third loudspeakers, wherein said first and third loudspeakers reproduce sound associated with signals received by said first and third loudspeakers; and wherein said signal processing circuitry is also configured to transmit said second input signal to said second and fourth loudspeakers, wherein said second and fourth loudspeakers reproduce sound associated with signals received by said second and fourth loudspeakers;

wherein no two adjacent loudspeakers reproduce the same input signal; and wherein the sound reproduced by said first, second, third and fourth loudspeakers is perceived by a listener to be a sound source larger than the physical size of the housing.

13. The system of claim 12 wherein the housing is a trapezoid with no side longer than 2 feet.

14. The system of claim 12, said signal processing circuitry further comprising signal modification means for modifying said first and second input signals; and means for transmitting said modified first and second input signals to said third and fourth loudspeakers.

15. The system of claim 14, wherein the signal modification means includes frequency response equalization including a band reject filter centered between 400 Hz and 2,000 Hz with bandwidth of greater than 1 octave and attenuation greater than minus 4 db.

16. The system of claim 12, said signal processing circuitry further comprising: signal means for delaying said first and second input signals by a time corresponding to a sound distance; and means for transmitting said delayed first and second input signals to said first and second loudspeakers, wherein the first and second loudspeakers are generally closer to a preferred listening area than the third and fourth loudspeakers.

17. The system of claim 16, wherein said sound distance is greater than or equal to the shortest distance between any two of said first, second, third and fourth loudspeakers and less than or equal to the largest distance between any two of said first, second, third and fourth loudspeakers.

18. The system of claim 17 wherein the sound distance is approximately equal to six inches.

19. The system of claim 17 wherein the sound reproduced by said first, second, third and fourth loudspeakers in said preferred listening area has reduced comb filtering.

20. The system. of claim 17 wherein the sound reproduced by said first, second, third and fourth loudspeakers in said preferred listening area has improved stereo imaging.

* * * * *